US010894589B1

(12) United States Patent
Ito et al.

(10) Patent No.: US 10,894,589 B1
(45) Date of Patent: Jan. 19, 2021

(54) SHIP MANEUVERING SYSTEM AND SHIP MANEUVERING METHOD

(71) Applicant: YAMAHA HATSUDOKI KABUSHIKI KAISHA, Iwata (JP)

(72) Inventors: Makoto Ito, Shizuoka (JP); Kohei Yamaguchi, Shizuoka (JP); Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 16/827,847

(22) Filed: Mar. 24, 2020

Related U.S. Application Data

(60) Provisional application No. 62/823,113, filed on Mar. 25, 2019.

(51) Int. Cl.

| | |
|---|---|
| ***B63H 20/14*** | (2006.01) |
| ***B63H 21/21*** | (2006.01) |
| ***B63H 23/04*** | (2006.01) |
| ***B63H 23/12*** | (2006.01) |
| *B63H 20/00* | (2006.01) |
| *B63H 23/02* | (2006.01) |

(52) U.S. Cl.
CPC ..... *B63H 20/14* (2013.01); *B63H 21/21* (2013.01); *B63H 23/04* (2013.01); *B63H 23/12* (2013.01); *B63H 2020/003* (2013.01); *B63H 2021/216* (2013.01); *B63H 2023/0258* (2013.01)

(58) Field of Classification Search
CPC ..... B63H 20/00; B63H 20/14; B63H 21/00; B63H 21/21; B63H 21/26; B63H 21/28; B63H 23/00; B63H 23/04; B63H 23/12
USPC ..... 440/86
See application file for complete search history.

(56) References Cited

U.S. PATENT DOCUMENTS

| | | | | |
|---|---|---|---|---|
| 7,325,506 | B2 * | 2/2008 | Yamashita | B63H 20/12 440/86 |
| 7,442,102 | B2 * | 10/2008 | Ito | B63H 21/22 440/86 |
| 9,709,996 | B2 * | 7/2017 | Ito | B63H 20/00 |

FOREIGN PATENT DOCUMENTS

| | | | |
|---|---|---|---|
| JP | 2016-216018 | A | 12/2016 |

* cited by examiner

*Primary Examiner* — Lars A Olson
(74) *Attorney, Agent, or Firm* — Keating and Bennett, LLP

(57) ABSTRACT

A ship maneuvering system includes first and second propulsion devices, a shift actuator, and a controller. The shift actuator switches a shift state of each of the propulsion devices. The controller causes the shift actuator of one of the first and second propulsion devices to execute intermittent control during low-speed navigation of the ship. The intermittent control intermittently switches the shift state to a shift-in state and a shift-out state.

18 Claims, 7 Drawing Sheets

SHIP MANEUVERING SYSTEM AND SHIP MANEUVERING METHOD

CROSS REFERENCE TO RELATED APPLICATIONS

This application claims the benefit of priority to U.S. Provisional Patent Application No. 62/823,113 filed on Mar. 25, 2019. The entire contents of this application are hereby incorporated herein by reference.

BACKGROUND OF THE INVENTION

1. Field of the Invention

The present invention relates to a ship maneuvering system and a ship maneuvering method.

2. Description of the Related Art

In the prior art, a ship maneuvering system that executes intermittent control during low-speed navigation of a ship is known.

For example, Japanese Patent Application Laid-Open No. 2016-216018 discloses a ship maneuvering system that executes intermittent control with one propulsion device during the low-speed navigation of the ship.

In recent years, a plurality of propulsion devices have been equipped on ships for complying with the speeding-up of ships. Therefore, it is desired to apply the above-described intermittent control technology to a ship equipped with a plurality of propulsion devices.

When all of the plurality of propulsion devices are intermittently controlled at the same time, the plurality of propulsion devices will engage at the same time. Therefore, as the number of propulsion devices increases, the user may feel uncomfortable with sound caused by the plurality of propulsion devices engaging at the same time. Also, when the shift state is switched from the shift-out state to the shift-in state during the intermittent control of the plurality of propulsion devices, the shift mechanism operates to transmit the driving force of the engine to the propeller. In this case, a shift shock and shift noise may occur when the shift mechanism operates.

SUMMARY OF THE INVENTION

Preferred embodiments of the present invention provide ship maneuvering systems each capable of suitably reducing sound during intermittent control of a ship, ship maneuvering systems each capable of suitably reducing shift shock and shift noise during intermittent control of a ship, and ship maneuvering methods each capable of suitably reducing the sound, shift shock, and shift noise.

A ship maneuvering system according to a preferred embodiment of the present invention includes a plurality of propulsion devices, a shift actuator, and a controller. The plurality of propulsion devices include a first propulsion device and a second propulsion device. The shift actuator switches a shift state of each of the plurality of propulsion devices. The controller causes the shift actuator to execute intermittent control to intermittently switch the shift state to a shift-in state and a shift-out state. The controller causes the shift actuator of one of the first propulsion device and the second propulsion device to execute the intermittent control during low-speed navigation of the ship.

A ship maneuvering method according to another preferred embodiment of the present invention includes a method executed by a controller to maneuver a ship including a plurality of propulsion devices.

The method includes causing a shift actuator to switch a shift state of each of the plurality of propulsion devices, causing the shift actuator to execute intermittent control to intermittently switch the shift state to a shift-in state and a shift-out state, and causing the shift actuator of one of a first propulsion device and a second propulsion device to execute the intermittent control during low-speed navigation of the ship. The plurality of propulsion devices include the first propulsion device and the second propulsion device.

According to preferred embodiments of the present invention, it is possible to reduce the sound, shift shock, and shift noise during intermittent control of a ship in the ship steering system and the ship steering method.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
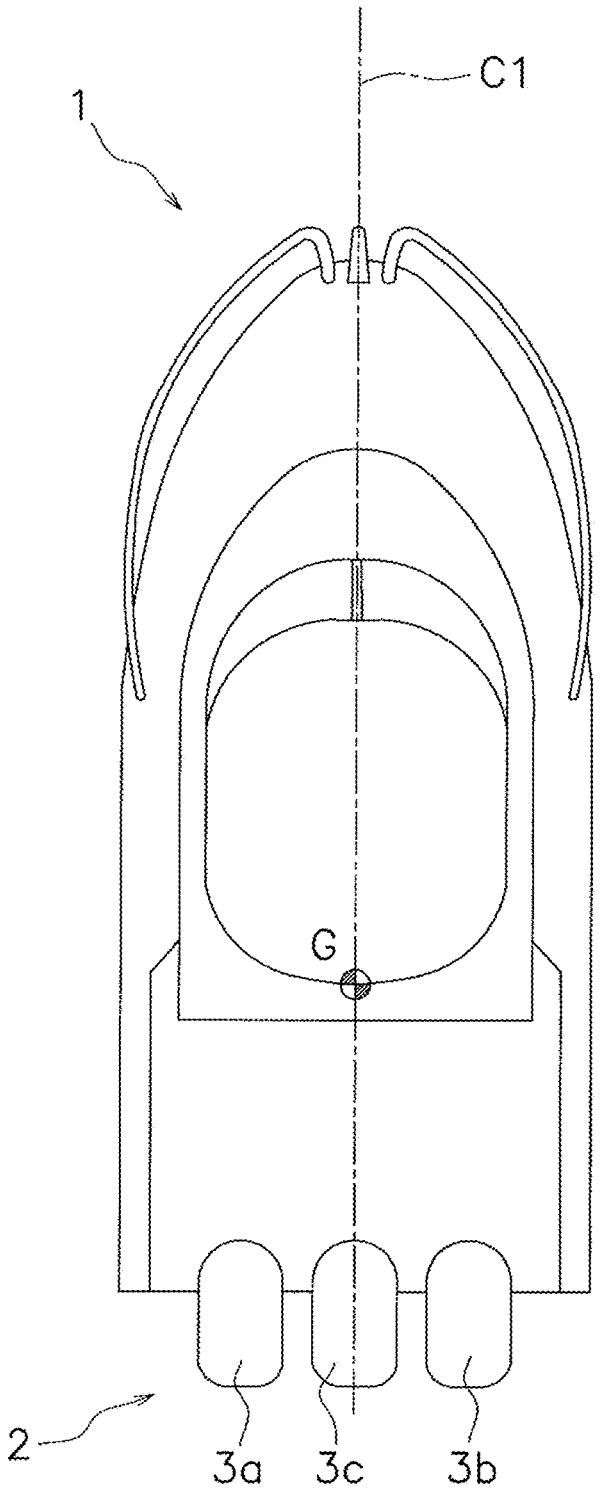
FIG. 1 is a top view of a ship according to a preferred embodiment of the present invention.

Hereinafter, preferred embodiments will be described with reference to the drawings. FIG. 1 is a top view of a ship 1 according to a preferred embodiment of the present invention. The ship 1 is equipped with the ship maneuvering system 2 according to a preferred embodiment of the present invention. As shown in FIG. 1, the ship maneuvering system 2 includes a plurality of propulsion devices 3*a*, 3*b*, 3*c*. The plurality of propulsion devices 3*a*, 3*b*, 3*c* are outboard motors, for example.

In the following description, the front, rear, left, right, up, and down directions mean the front, rear, left, right, up, and down directions of the ship 1, respectively. For example, a center line C1 extending in the front-rear direction of the ship 1 passes through the center of gravity G of the ship 1. The front-back direction extends along the center line C1. The forward direction heads upward along the center line C1 in FIG. 1. The rear extends downward along the center line C1 in FIG. 1.

The left-right direction (width direction) is perpendicular to the center line C1 in FIG. 1. The left direction is perpendicular to the center line C1 and on a left side of the center line C1 in FIG. 1. The right direction is perpendicular to the center line C1 and on a right side of the center line C1 in FIG. 1. The vertical direction is perpendicular to the front-rear direction and the left-right direction.

As shown in FIG. 1, the plurality of propulsion devices 3*a*, 3*b*, 3*c* are attached to the stern of the ship 1. Each of the plurality of propulsion devices 3*a*, 3*b*, 3*c* generates a thrust to propel the ship 1. Specifically, each of the plurality of propulsion devices 3*a*, 3*b*, 3*c* generates the thrust to propel the ship 1 forward and backward.

Specifically, the ship 1 includes a left propulsion device 3*a*, a right propulsion device 3*b*, and a middle propulsion device 3*c*. The left propulsion device 3*a* and the right propulsion device 3*b* are examples of "a plurality of first propulsion devices". The middle propulsion device 3*b* is an example of "at least one second propulsion device".

The left propulsion device 3*a*, the right propulsion device 3*b*, and the middle propulsion device 3*c* are disposed side by side in one direction. For example, the left propulsion device 3*a*, the right propulsion device 3*b*, and the middle propulsion device 3*c* are disposed side by side in the width direction (left-right direction) of the ship 1. The middle propulsion device 3 is disposed between the left propulsion device 3*a* and the right propulsion device 3*b*.

Specifically, the left propulsion device 3*a* is disposed on the left side of the center line C1. The right propulsion device 3*b* is disposed on the right side of the center line C1. The middle propulsion device 3*c* is disposed between the left propulsion device 3*a* and the right propulsion device 3*b*. The middle propulsion device 3*c* is disposed on the center line C1.

The left propulsion device 3*a*, the right propulsion device 3*b*, and the middle propulsion device 3*c* have the same configuration as each other. Therefore, the propulsion device will be described using the left propulsion device 3*a*.

Figure 2:
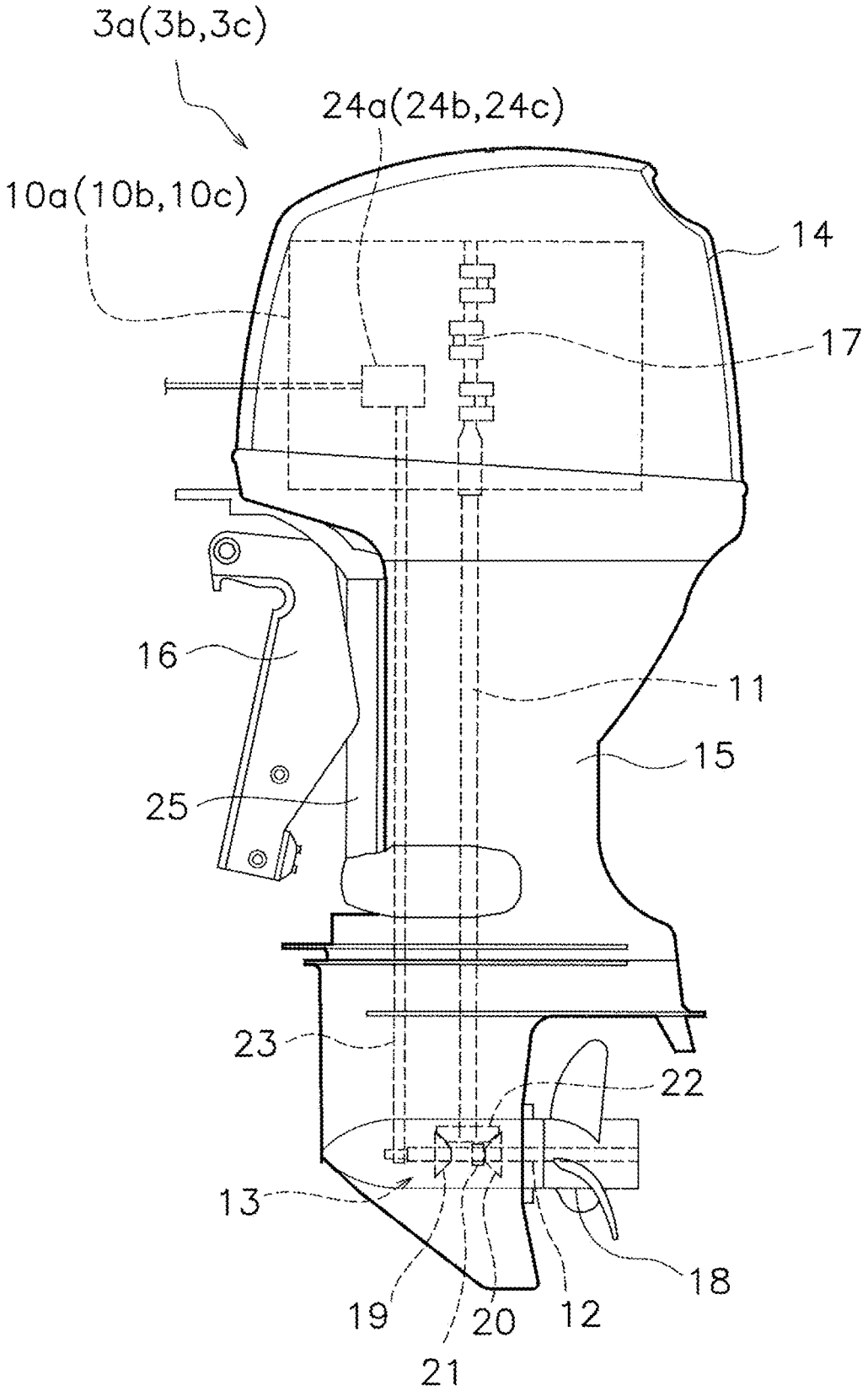
FIG. 2 is a side view of a left propulsion device.

FIG. 2 is a side view of the left propulsion device 3*a*. The left propulsion device 3*a* includes an engine 10*a*, a drive shaft 11, a propeller shaft 12, a shift mechanism 13, an engine cowl 14, a housing 15, and a bracket 16.

The engine 10*a* is a power source that generates the thrust of the ship 1. The engine 10*a* is disposed inside the engine cowl 14. The engine 10*a* includes a crankshaft 17. The crankshaft 17 extends in the vertical direction.

The drive shaft 11 is connected to crankshaft 17. The drive shaft 11 extends downward from the engine 10*a*. The propeller shaft 12 extends in a direction intersecting the drive shaft 11. The propeller shaft 12 extends in the front-rear direction. The propeller shaft 12 is connected to the drive shaft 11 via a shift mechanism 13. A propeller 18 is connected to the propeller shaft 12.

The housing 15 is disposed below the engine cowl 14. The drive shaft 11, the propeller shaft 12, and the shift mechanism 13 are disposed in a housing 15. The shift mechanism 13 switches the rotation direction of the power transmitted from the drive shaft 11 to the propeller shaft 12.

The shift mechanism 13 includes a forward gear 19, a reverse gear 20, and a clutch 21. The forward gear 19 and the reverse gear 20 mesh with the bevel gear 22. The bevel gear 22 is attached to the drive shaft 11. The clutch 21 selectively engages the forward gear 19 and the reverse gear 20 with the propeller shaft 12. The clutch 21 is able to move between a forward position, a reverse position, and a neutral position.

The clutch 21 engages the forward gear 19 with the propeller shaft 12 in the forward position. Thus, the rotation of the drive shaft 11 is transmitted to the propeller shaft 12, and the propeller shaft 12 rotates in the forward direction.

The clutch 21 engages the reverse gear 20 with the propeller shaft 12 in the reverse position. Thus, the rotation of the drive shaft 11 is transmitted to the propeller shaft 12, and the propeller shaft 12 rotates in the reverse direction.

When the clutch 21 is positioned at the neutral position, the forward gear 19 and the reverse gear 20 are released from the propeller shaft 12. In this case, the rotation of the drive shaft 11 is not transmitted to the propeller shaft 12.

The left propulsion device 3*a* further includes a shift member 23 and a shift actuator 24*a*. The shift member 23 is connected to the shift mechanism 13. The shift member 23 operates the shift mechanism 13.

Specifically, the shift member 23 is connected to the clutch 21. The shift member 23 is driven by the shift actuator 24*a*. Thus, the clutch 21 moves to each of the forward position, the reverse position, and the neutral position.

The shift actuator 24*a* is connected to the shift member 23. The shift actuator 24*a* drives the shift member 23. The shift actuator 24*a* is, for example, an electric motor. The shift actuator 24*a* switches the clutch 21 to one of the forward position, the reverse position, and the neutral position by driving the shift member 23.

When the clutch 21 is positioned at the forward position and the reverse position, the clutch 21 is in a shift-in state. When the clutch 21 is positioned at the neutral position, the clutch 21 is in a shift-out state. Thus, the shift actuator 24*a* switches the shift state to one of the shift-in state and the shift-out state via the clutch 21.

The bracket 16 attaches the left propulsion device 3*a* to the ship 1. The left propulsion device 3 is detachably fixed to the stern of the ship 1 via the bracket 16. The bracket 16 includes a steering shaft 25. The left propulsion device 3*a* is supported by the bracket 16 so as to rotate around a steering shaft 25.

Figure 3:
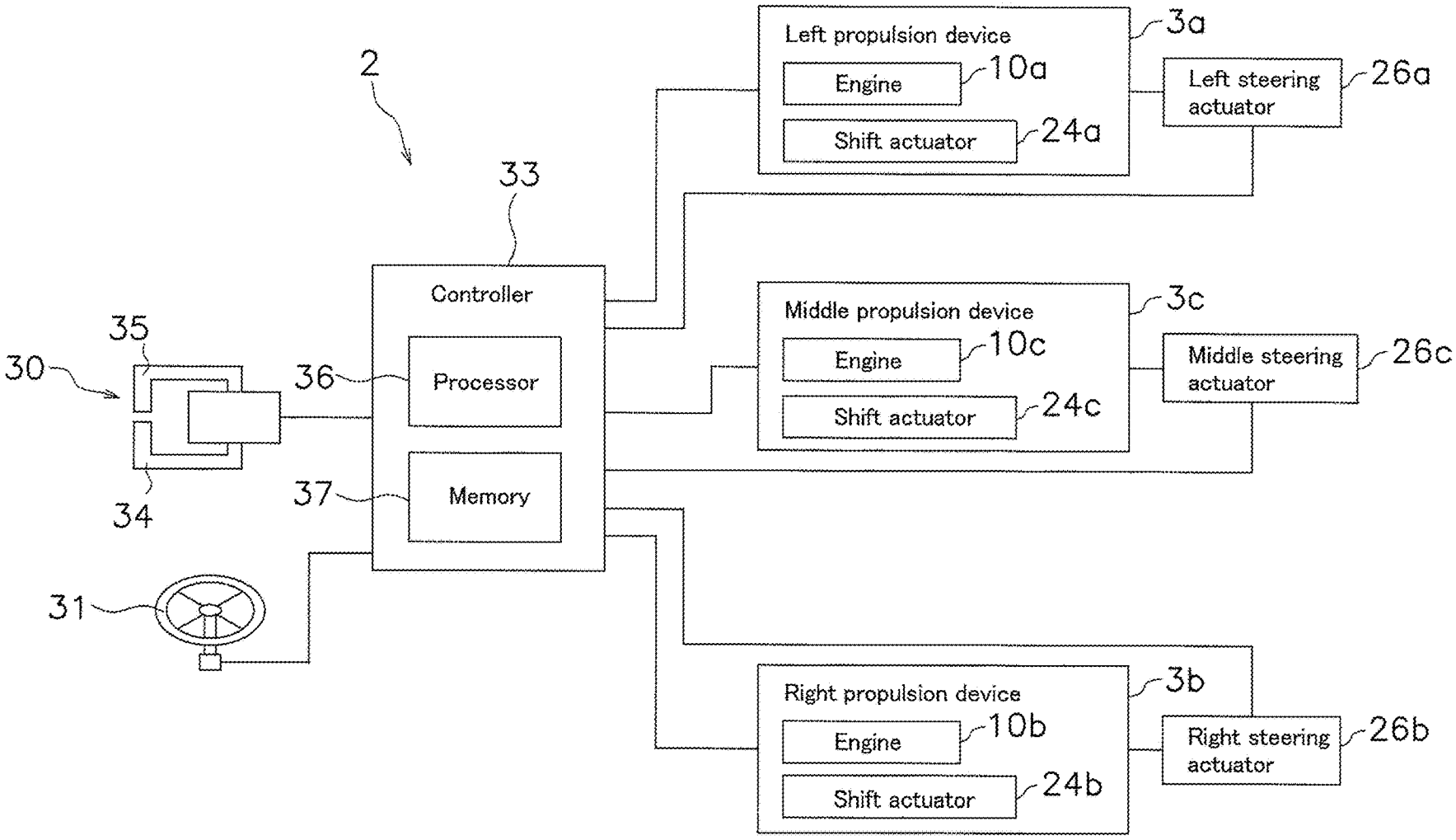
FIG. 3 is a schematic diagram showing a ship maneuvering system according to a preferred embodiment of the present invention.

FIG. 3 is a schematic diagram showing a configuration of the ship maneuvering system 2.

The ship maneuvering system 2 includes the left propulsion device 3*a*, the right propulsion device 3*b*, and the middle propulsion device 3*c*. As described above, each of the right propulsion device 3*b* and the middle propulsion device 3*c* has the same configuration (the configuration in FIG. 2) as the left propulsion device 3*a*.

As shown in FIG. 3, the left propulsion device 3*a*, the right propulsion device 3*b*, and the middle propulsion device 3*c* respectively include engines 10*a*, 10*b*, 10*c* and shift actuators 24*a*, 24*b*, 24*c*.

The ship maneuvering system 2 includes a plurality of steering actuators 26*a*, 26*b*, 26*c*. The plurality of steering actuators 26*a*, 26*b*, 26*c* are respectively connected to the left propulsion device 3*a*, the right propulsion device 3*b*, and the middle propulsion device 3*c*.

The steering actuators 26*a*, 26*b*, 26*c* rotate the propulsion devices 3*a*, 3*b*, 3*c* around the steering shaft 25. Thus, the steering actuators 26*a*, 26*b*, 26*c* change the steering angles of the respective propulsion devices 3*a*, 3*b*, 3*c*.

Each of the steering actuators 26*a*, 26*b*, 26*c* includes, for example, a hydraulic cylinder. Each of the steering actuators 26*a*, 26*b*, 26*c* may include an electric cylinder or an electric motor.

The ship maneuvering system 2 further includes a remote control device 30, a steering device 31, and a controller 33.

The remote control device 30 includes a first operation member 34 and a second operation member 35. The first operation member 34 and the second operation member 35 are operated by a user to control the left propulsion device 3*a*, the right propulsion device 3*b*, and the middle propulsion device 3*c*. The remote control device 30 transmits a signal indicating an operation of the first and second operation members 34 and 35 to the controller 33.

Each of the first operation member 34 and the second operation member 35 is, for example, a lever. The first operation member 34 and the second operation member 35 are operable to a forward position, a reverse position, and a neutral position. The first operation member 34 and the second operation member 35 are able to change direction of the thrust of each of the propulsion devices 3*a*, 3*b*, 3*c* and the magnitude of the thrust (a throttle opening).

The steering device 31 is, for example, a steering wheel. The steering device 31 is operated by the user to control the steering angles of the propulsion devices 3*a*, 3*b*, 3*c*. The steering device 31 is operable to a left turning position, a right turning position, and a neutral position. The steering device 31 transmits a signal indicating the position of the steering device 31 to the controller 33.

The controller 33 includes a processor 36 and a memory (an example of a recording portion). The memory 37 includes a volatile memory such as a RAM. The memory 37 includes a nonvolatile memory such as a ROM. The controller 33 may include an auxiliary storage device such as a hard disk and/or an SSD. Further, an external storage device (not illustrated) such as a hard disk and/or an SSD (not illustrated) may be connected to the controller 33.

The processor 36 is, for example, a CPU (Central Processing Unit), and executes processes to control the propulsion devices 3*a*, 3*b*, 3*c* and the steering actuators 26*a*, 26*b*, 26*c* according to a program.

The memory 37 stores programs and data to control the propulsion devices 3*a*, 3*b*, 3*c* and the steering actuators 26*a*, 26*b*, 26*c*.

The memory 37 stores a duty ratio. The duty ratio is the ratio (TI/TO×100) of the shift-in time TI to the shift-out time TO. For example, the duty ratio is used during execution of the intermittent control. The memory 37 stores the duty ratio as an initial value. The memory 37 stores the duty ratio that changes during the intermittent control.

The memory 37 stores a first threshold and a second threshold. The first threshold and the second threshold are used to control the shift actuators 24*a*, 24*b*, 24*c*. The first threshold is larger than the second threshold. In the present preferred embodiment, for example, the first threshold is set to 50%. For example, the second threshold is set to 30%.

The memory 37 stores a target speed which is set when the ship 1 is traveling during a low-speed navigation of the ship 1. The preset target speed may be stored in the memory 37, or the target speed may be stored in the memory 37 by the user inputting the target speed to an input device (not illustrated).

The memory 37 stores the actual speed of the ship 1 during low-speed navigation of the ship 1. The actual speed of the ship 1 may be acquired from a GPS (Global Positioning System) or the like, or may be acquired from a speed detector (not illustrated) mounted on the ship 1.

The controller 33 controls the propulsion devices 3*a*, 3*b*, 3*c* and the steering actuators 26*a*, 26*b*, 26*c* based on the signals from the steering device 31 and the remote control device 30.

Specifically, the controller 33 controls the direction and the magnitude of the thrust of the propulsion devices 3*a*, 3*b*, 3*c* according to the positions of the first and second operation members 34, 35. For example, the controller 33 controls the magnitude of the thrust of each of the left propulsion device 3*a*, the right propulsion device 3*b*, and the middle propulsion device 3*c* by controlling the throttle opening of each of the engines 10*a*, 10*b*, 10*c*.

The controller 33 controls the shift actuators 24*a*, 24*b*, 24*c* according to the positions of the first and second operation members 34, 35. Thus, the clutch 21 of the shift mechanism 13 is switched to one of the forward position, the reverse position, and the neutral position. As a result, the thrusts of the propulsion devices 3*a*, 3*b*, 3*c* are switched to one of forward, rear, and neutral.

The controller 33 causes the shift actuators 24*a*, 24*b*, 24*c* to execute intermittent control to intermittently switch the shift state of each of the plurality of propulsion devices 3*a*, 3*b*, 3*c* to the shift-in state and the shift-out state.

The controller 33 sets the shift state of the ship 1 to the shift-in state by causing the shift actuator 24*a* to execute the shift-in control. Also, the controller 33 sets the shift state of the ship 1 to the shift-out state by causing the shift actuator 24*a* to execute the shift-out control.

For example, the controller 33 provides an intermittent control command to at least one of the shift actuators 24*a*, 24*b*, 24*c*. Thus, at least one of the shift actuators 24*a*, 24*b*, 24*c* executes the intermittent control.

The controller 33 controls the steering actuators 26*a*, 26*b*, 26*c* according to the position of the steering device 31. Thus, the steering angles of the propulsion devices 3*a*, 3*b*, 3*c* are controlled.

Figure 4:
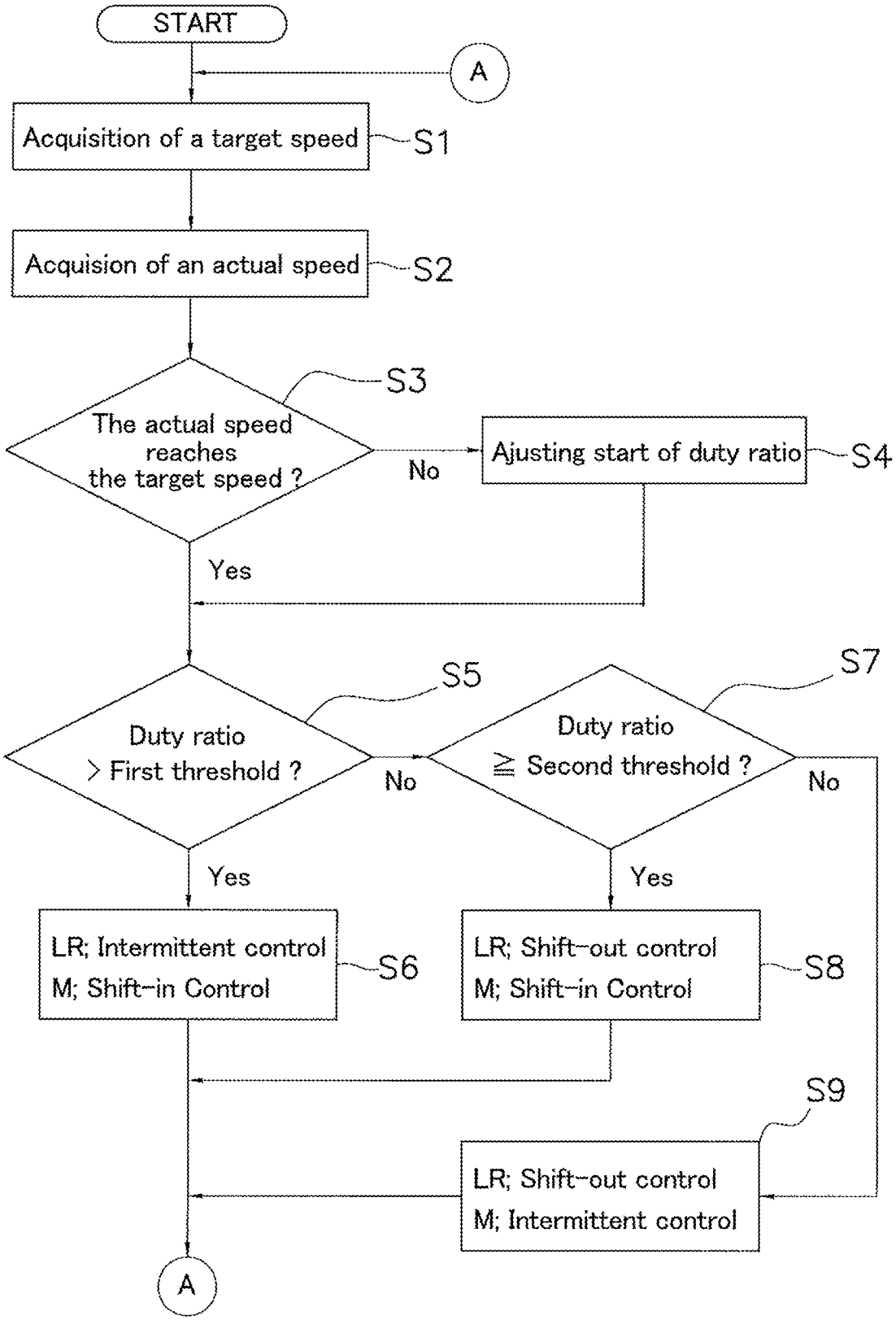
FIG. 4 is a flowchart for explaining intermittent control of a propulsion device.

FIG. 4 is a flowchart indicating an example of a case in which the propulsion devices 3*a*, 3*b*, 3*c* are intermittently controlled when the speed of the ship 1 approaches the target speed during low-speed navigation of the ship 1. FIGS. 5A to 5D is a schematic diagram showing the operating state of the propulsion devices 3*a*, 3*b*, 3*c*. In FIGS. 5A to 5D, the shift-in state is indicated by "I", the shift-out state is indicated by "O", and the intermittent state is indicated by "P".

The low-speed navigation of the ship 1 includes a trawl state, which is a state in which the shift state of each of the plurality of propulsion devices 3*a*, 3*b*, 3*c* is a shift-in state (the state of FIG. 5A) and the throttle opening is an opening for a low speed. The state in which the throttle opening is the opening for low speed includes the state in which the throttle opening is the idling opening.

The controller 33 acquires the target speed of the ship 1 from the memory 37 (S1). This target speed is stored in the memory 37.

The controller 33 acquires the actual speed of the ship 1 (S2). For example, the controller 33 acquires the actual speed of the ship 1 from, for example, a GPS or the speed detector. The actual speed of the ship 1 is the current speed of the ship 1. This actual speed is recorded in the memory 37.

The controller 33 determines whether or not the actual speed of the ship 1 has reached the target speed (S3). When the actual speed of the ship 1 has reached the target speed (Yes in S3), the controller 33 executes Step 5 (S5) described below. On the other hand, when the actual speed of the ship 1 has not reached the target speed (No in S3), the controller 33 executes Step 4 (S4) described below.

When the actual speed of the ship 1 has not reached the target speed (No in S3), the controller 33 starts adjusting the duty ratio based on the actual speed of the ship 1 and the target speed to bring the actual speed of the ship 1 closer to the target speed (S4). For example, when the actual speed of the ship 1 is higher than the target speed, the controller 33 increases the duty ratio. When the actual speed of the ship 1 is lower than the target speed, the controller 33 reduces the duty ratio.

Thus, the controller 33 brings the speed of the ship 1 closer to the target speed. Thus, the controller 33 executes the feedback control with the duty ratio so that the speed of the ship 1 approaches the target speed. The feedback control is the same or substantially the same as that of the prior art, and the description thereof is omitted here.

When the controller 33 starts adjusting the duty ratio in step 4 (S4), the controller 33 determines whether or not the adjusted duty ratio is larger than the first threshold (S5). When the process does not go through the above Step 4 (S4), that is, the actual speed of the ship 1 has reached the target speed (Yes in S3), the controller 33 determines whether or not the current duty ratio (including the duty ratio as the initial value) is larger than the first threshold (S5).

When the duty ratio is larger than the first threshold (Yes in S5), the controller 33 causes the shift actuators 24*a*, 24*b* of the left propulsion device 3*a* and the right propulsion device 3*b* to execute intermittent control. Also, the controller 33 causes the shift actuator 24*c* of the middle propulsion device 3*c* to execute shift-in control. Thus, as shown in FIG. 5B, the left propulsion device 3*a* and the right propulsion device 3*b* operate in an intermittent state, and the middle propulsion device 3*c* operates in a shift-in state (S6).

When the duty ratio is equal to or smaller than the first threshold (No in S5), the controller 33 determines whether or not the duty ratio is equal to or larger than the second threshold (S7). When the duty ratio is equal to or larger than the second threshold (Yes in S7), the controller 33 causes the shift actuators 24*a*, 24*b* of the left propulsion device 3*a* and the right propulsion device 3*b* to execute the shift-out control, and causes the shift actuator 24*c* of the medium propulsion device 3*c* to execute the shift-in control.

Figures 5A, 5B, 5C, 5D:
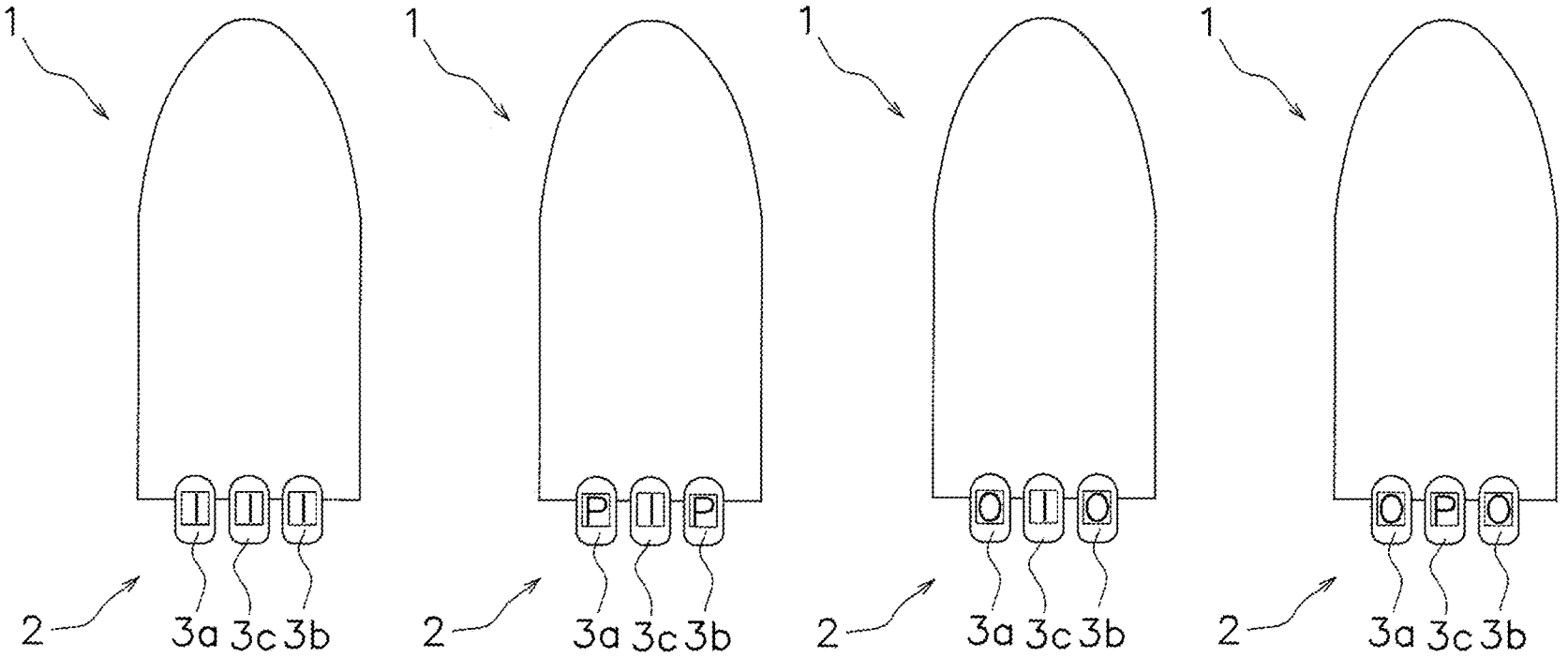
FIGS. 5A to 5D are figures showing intermittent control state of the propulsion device.

Thus, as shown in FIG. 5C, the left propulsion device 3*a* and the right propulsion device 3*b* stop, and the middle propulsion device 3*c* operates in the shift-in state (S8). In this case, the left propulsion device 3*a*, the right propulsion device 3*b*, and the middle propulsion device 3*c* do not execute the intermittent control.

When the duty ratio is smaller than the second threshold (No in S7), the controller 33 causes the shift actuator 24*c* of the middle propulsion device 3*c* to execute the intermittent control. Thus, as shown in FIG. 5C, the left propulsion device 3*a* and the right propulsion device 3*b* stop, and the middle propulsion device 3*c* operates in an intermittent state (S9).

During the execution of Step 6 (S6), Step 8 (S8), or Step 9 (S9), the controller 33 monitors the state of the ship 1. For example, the controller 33 executes the process of Steps 1 (S1) to 7 (S7) except for Step 6 (S6). Thus, the propulsion devices 3*a*, 3*b*, 3*c* are controlled such as Step 6 (S6), Step 8 (S8), or Step 9 (S9) according to the duty ratio. The above-described flow ends when the controller 33 acquires a stop command of the intermittent control.

In the ship maneuvering system 2 described above, not all of the plurality of propulsion devices 3*a*, 3*b*, 3*c* are intermittently controlled at the same time, but some of the plurality of propulsion devices 3*a*, 3*b*, 3*c* (the propulsion devices 3*a*, 3*b* or the propulsion device 3*c*) are intermittently controlled.

Accordingly, the number of propulsion devices 3*a*, 3*b*, 3*c* that are intermittently controlled is reduced, so that the sound generated in the ship 1 is reduced appropriately. Also, even if the shift state is switched from the shift-out state to the shift-in state during the intermittent control of the propulsion devices 3*a*, 3*b*, 3*c*, the shift shock and the shift noise is reduced when the shift mechanism 13 operates. Further, since the number of shift changes in each of the propulsion devices 3*a*, 3*b*, 3*c* is reduced, wear of the shift mechanism 13 is reduced. In other words, the durability of the shift mechanism 13 is improved.

In the prior art, when the propulsion device is in the shift-out state during the intermittent control, the traveling direction of the ship 1 cannot be changed even if the steering device 31 is operated. On the other hand, in the ship maneuvering system 2, when the duty ratio is equal to or larger than the second threshold, at least one of the propulsion devices 3*a*, 3*b*, 3*c* is always in the shift-in state. Therefore, in the ship maneuvering system 2, when the duty ratio is equal to or larger than the second threshold, the traveling direction of the ship 1 is able to be changed even if the steering device 31 is operated during the intermittent control. In other words, in the ship maneuvering system 2, the steering performance of the ship 1 is improved.

In the above-described preferred embodiments, an example in which the ship maneuvering system 2 is executed with the first threshold and the second threshold has been described. However, the ship maneuvering system 2 can be executed with only the first threshold. In this case, the ship maneuvering system 2 is executed as follows.

Figure 6:
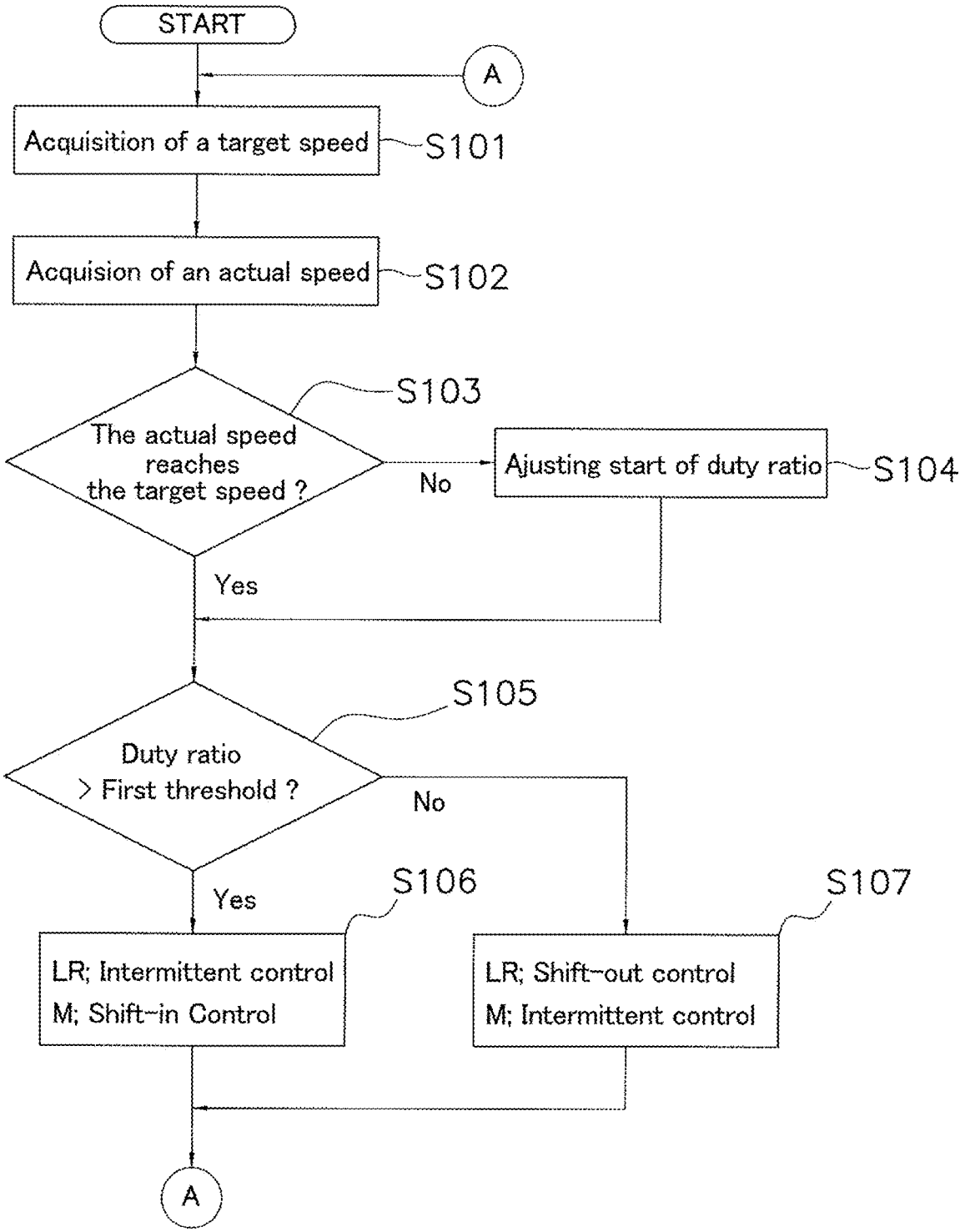
FIG. 6 is a flowchart for explaining the intermittent control of the propulsion device as a variation of a preferred embodiment of the present invention.

As shown in FIG. 6, the process of Step 101 to 104 (S101-S104) is the same as the process of Steps 1 to 4 (S1-S4) in the preferred embodiments described above. Therefore, the description is omitted here.

The controller 33 determines whether or not the duty ratio is larger than the first threshold (S105). When the duty ratio is larger than the first threshold (Yes in S105), as shown in FIG. 5B, the controller 33 causes the shift actuators 24*a*, 24*b* of the left propulsion device 3*a* and the right propulsion device 3*b* to execute the intermittent control. Also, the controller 33 causes the shift actuator 24*c* of the middle propulsion device 3*c* to execute the shift-in control. Thus, the left propulsion device 3*a* and the right propulsion device 3*b* operate in the intermittent state, and the middle propulsion device 3*c* operates in the shift-in state (S106).

When the duty ratio is equal to or smaller than the first threshold (No in S105), as shown in FIG. 5D, the controller 33 causes the shift actuator 24*c* of the middle propulsion device 3*c* to execute the intermittent control. Thus, the left propulsion device 3*a* and the right propulsion device 3*b* stop, and the middle propulsion device 3*c* operate in the intermittent state (S107). Even with such a configuration, the same effects as in the above-described preferred embodiments are obtained.

In the above-described preferred embodiments, an example was described in which the number of propulsion devices (3*a*, 3*b*, 3*c*) is three, but the number of propulsion devices can be four or more. For example, when there are four propulsion devices, as shown in FIGS. 7A to 7D, each propulsion device is controlled by the controller 33.

Figures 7A, 7B, 7C, 7D:
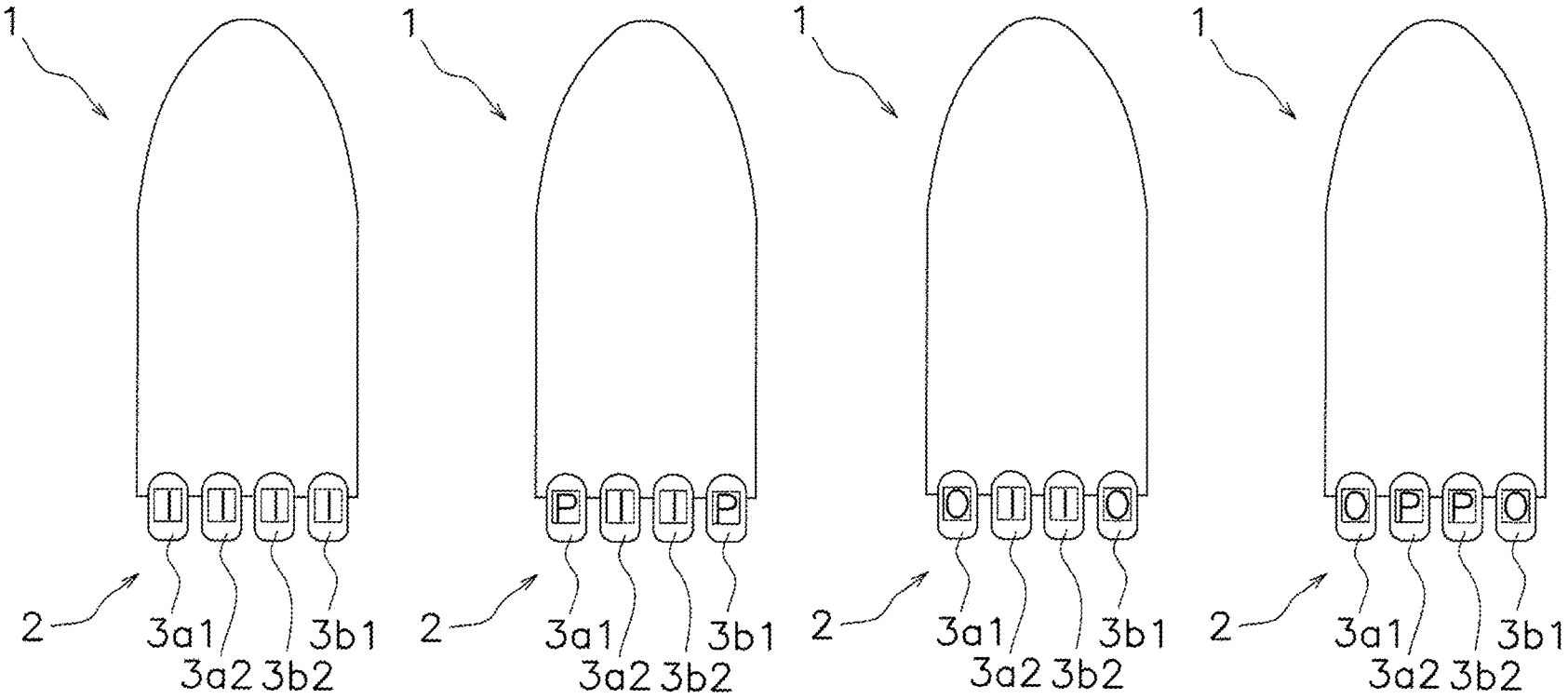
FIGS. 7A to 7D are figures showing the control state of the propulsion device as another preferred embodiment of the present invention.

In this case, FIG. 7A shows a case in which the shift state of each of the plurality of propulsion devices 3*a*1, 3*a*2, 3*b*1, 3*b*2 is in the shift-in state. In this state, when the duty ratio is larger than the first threshold, as shown in FIG. 7B, the left propulsion device 3*a*1 and the right propulsion device 3*b*1 operate in the intermittent state, and the left middle propulsion device 3*a*2 and the right middle propulsion device 3*b*2 operate in the shift-in state.

When the duty ratio is equal to or less than the first threshold and equal to or larger than the second threshold, as shown in FIG. 7C, the left propulsion device 3*a*1 and the right propulsion device 3*b*1 are stopped, and the left middle propulsion device 3*a*2 and the right middle propulsion device 3*b*2 operate in the shift-in state. Also, when the duty ratio is smaller than the second threshold, as shown in FIG. 7D, the left propulsion device 3*a*1 and the right propulsion device 3*b*1 are stopped, and the left middle propulsion device 3*a*2 and the right middle propulsion device 3*b*2 operate in an intermittent state. In this configuration, the same effects as in the above-described preferred embodiments are obtained.

In the above-described preferred embodiments, an example in which the speed of the ship 1 is adjusted with the target speed has been described, but the speed of the ship 1 can be adjusted with the target duty ratio.

In this case, the memory 37 stores the target duty ratio which is set during the low-speed navigation of the ship 1. The preset target duty ratio may be stored in the memory 37, or the target duty ratio may be stored in the memory 37 by the user inputting the target duty ratio to an input device (not illustrated).

In this case, the controller 33 adjusts the duty ratio so that the duty ratio approaches the target duty ratio. For example, the controller 33 changes the duty ratio stepwise so that the duty ratio approaches the target duty ratio.

For example, the duty ratio is changed stepwise with the difference value stored in the memory 37. The duty ratio is able to be changed stepwise with the difference value input to an input device (not illustrated) by the operator.

In the process in which the duty ratio changes stepwise, the controller 33 executes the process after Step 5 (S5) or Step 105 (S105) with the first threshold and the second threshold (the first threshold in the example of the above-described variation). In this configuration, the same effects as in the above-described preferred embodiments are obtained.

According to preferred embodiments of the present invention, it is possible to reduce the sound, shift shock, and shift noise during intermittent control of a ship.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A ship maneuvering system comprising:

a plurality of propulsion devices including a first propulsion device and a second propulsion device;

a shift actuator to switch a shift state of each of the plurality of propulsion devices; and a controller configured or programmed to:

cause the shift actuator to execute intermittent control to intermittently switch the shift state to a shift-in state and a shift-out state; and cause the shift actuator of one of the first propulsion device and the second propulsion device to execute the intermittent control during navigation of a ship at or below a predetermined speed.

2. The ship maneuvering system according to claim 1, wherein the controller is configured or programmed to adjust a duty ratio of time in the shift-in state to time in the shift-out state during execution of the intermittent control; and when the duty ratio is greater than a first threshold, the controller is configured or programmed to cause the shift actuator of the first propulsion device to execute the intermittent control and to cause the shift actuator of the second propulsion device to execute a shift-in control to set the shift state to the shift-in state.

3. The ship maneuvering system according to claim 1, wherein the controller is configured or programmed to adjust a duty ratio of time in the shift-in state to time in the shift-out state during the execution of the intermittent control; and when the duty ratio is smaller than a second threshold, the controller is configured or programmed to cause the shift actuator of the first propulsion device to execute a shift-out control to set the shift state to the shift-out state and to cause the shift actuator of the second propulsion device to execute the intermittent control.

4. The ship maneuvering system according to claim 1, wherein the controller is configured or programmed to adjust a duty ratio of time in the shift-in state to time in the shift-out state during the execution of the intermittent control;

when the duty ratio is greater than a first threshold, the controller is configured or programmed to cause the shift actuator of the first propulsion device to execute the intermittent control and to cause the shift actuator of the second propulsion device to execute a shift-in control to set the shift state to the shift-in state; and when the duty ratio is smaller than a second threshold which is equal to or less than the first threshold, the controller is configured or programmed to cause the shift actuator of the first propulsion device to execute a shift-out control to set the shift state to the shift-out state and to cause the shift actuator of the second propulsion device to execute the intermittent control.

5. The ship maneuvering system according to claim 4, wherein, when the duty ratio is equal to or smaller than the first threshold and equal to or larger than the second threshold, the controller is configured or programmed to cause the shift actuator of the first propulsion device to execute the shift-out control and to cause the shift actuator of the second propulsion device to execute the shift-in control.

6. The ship maneuvering system according to claim 1, wherein the controller is configured or programmed to adjust a duty ratio of time in the shift-in state to time in the shift-out state during the execution of the intermittent control;

when the duty ratio is greater than a first threshold, the controller is configured or programmed to cause the shift actuator of the first propulsion device to execute the intermittent control and to cause the shift actuator of the second propulsion device to execute a shift-in control to set the shift state to the shift-in state; and when the duty ratio is equal to or less than the first threshold, the controller is configured or programmed to cause the shift actuator of the first propulsion device to execute a shift-out control to set the shift state to the shift-out state and to cause the shift actuator of the second propulsion device to execute the intermittent control.

7. The ship maneuvering system according to claim 1, wherein the controller is configured or programmed to acquire a target speed of the ship, to detect an actual speed of the ship, and to adjust a duty ratio of time in the shift-in state to time in the shift-out state so that the actual speed of the ship approaches the target speed during the execution of the intermittent control.

8. The ship maneuvering system according to claim 1, wherein the controller is configured or programmed to acquire a target duty ratio and to adjust a duty ratio of time in the shift-in state to time in the shift-out state so that the duty ratio approaches the target duty ratio during the execution of the intermittent control.

9. The ship maneuvering system according to claim 1, wherein the plurality of propulsion devices include a plurality of the first propulsion devices and at least one second propulsion device;

the plurality of first propulsion devices and the at least one second propulsion device are disposed side by side in a first direction; and the at least one second propulsion device is disposed between the plurality of the first propulsion devices.

10. A ship maneuvering method executed by a controller to maneuver a ship including a plurality of propulsion devices, the method comprising:

causing a shift actuator to switch a shift state of each of the plurality of propulsion devices;

causing the shift actuator to execute intermittent control to intermittently switch the shift state to a shift-in state and a shift-out state; and causing the shift actuator of one of a first propulsion device and a second propulsion device to execute the intermittent control during navigation of the ship at or below a predetermined speed; wherein the plurality of propulsion devices include the first propulsion device and the second propulsion device.

11. The ship maneuvering method according to claim 10, further comprising:

adjusting a duty ratio of time in the shift-in state to time in the shift-out state during execution of the intermittent control; wherein when the duty ratio is greater than a first threshold, the shift actuator of the first propulsion executes the intermittent control and the shift actuator of the second propulsion device executes a shift-in control to set the shift state to the shift-in state.

12. The ship maneuvering method according to claim 10, further comprising:

adjusting a duty ratio of time in the shift-in state to time in the shift-out state during the execution of the intermittent control; wherein when the duty ratio is smaller than a second threshold, the shift actuator of the first propulsion device executes a shift-out control to set the shift state to the shift-out state and the shift actuator of the second propulsion device executes the intermittent control.

13. The ship maneuvering method according to claim 10, further comprising:

adjusting a duty ratio of time in the shift-in state to time in the shift-out state during the execution of the intermittent control; wherein when the duty ratio is greater than a first threshold, the shift actuator of the first propulsion device executes the intermittent control and the shift actuator of the second propulsion device executes a shift-in control to set the shift state to the shift-in state; and when the duty ratio is smaller than a second threshold which is equal to or less than the first threshold, the shift actuator of the first propulsion device executes a shift-out control to set the shift state to the shift-out state and the shift actuator of the second propulsion device executes the intermittent control.

14. The ship maneuvering method according to claim 13, wherein, when the duty ratio is equal to or smaller than the first threshold and equal to or larger than the second threshold, the shift actuator of the first propulsion device executes the shift-out control and the shift actuator of the second propulsion device executes the shift-in control.

15. The ship maneuvering method according to claim 10, further comprising:

adjusting a duty ratio of time in the shift-in state to time in the shift-out state during the execution of the intermittent control;

when the duty ratio is greater than a first threshold, the shift actuator of the first propulsion device executes the intermittent control and the shift actuator of the second propulsion device executes a shift-in control to set the shift state to the shift-in state; and when the duty ratio is equal to or less than the first threshold, the shift actuator of the first propulsion device executes a shift-out control to set the shift state to the shift-out state and the shift actuator of the second propulsion device executes the intermittent control.

16. The ship maneuvering method according to claim 10, further comprising:

acquiring a target speed of the ship;

detecting an actual speed of the ship; and adjusting a duty ratio of time in the shift-in state to time in the shift-out state so that the actual speed of the ship approaches the target speed during the execution of the intermittent control.

17. The ship maneuvering method according to claim 10, further comprising:

acquiring a target duty ratio; and adjusting a duty ratio of time in the shift-in state to time in the shift-out state so that the duty ratio approaches the target duty ratio during the execution of the intermittent control.

18. The ship maneuvering method according to claim 10, wherein the plurality of propulsion devices include a plurality of the first propulsion devices and at least one second propulsion device;

the plurality of first propulsion devices and the at least one second propulsion device are disposed side by side in a first direction; and the at least one second propulsion device is disposed between the plurality of the first propulsion devices.

* * * * *